US008884772B1

(12) United States Patent
Zhang

(10) Patent No.: US 8,884,772 B1
(45) Date of Patent: Nov. 11, 2014

(54) BUILDING EVACUATION SYSTEM WITH POSITIVE ACKNOWLEDGMENT

(71) Applicant: Globestar Systems, Inc., Toronto (CA)

(72) Inventor: Yihan Zhang, Thornhill (CA)

(73) Assignee: Globestar, Inc., Toronto (CA)

( * ) Notice: Subject to any disclaimer, the term of this patent is extended or adjusted under 35 U.S.C. 154(b) by 100 days.

(21) Appl. No.: 13/873,908

(22) Filed: Apr. 30, 2013

(51) Int. Cl.
*G08B 17/10* (2006.01)

(52) U.S. Cl.
USPC ..... 340/628; 340/506; 340/577; 340/573.1

(58) Field of Classification Search
USPC ..... 340/628, 630, 632, 500, 502, 506, 340/539.1, 573.1, 577; 705/1, 317; 182/18, 182/82; 187/390
See application file for complete search history.

(56) References Cited

U.S. PATENT DOCUMENTS

| | | | | |
|---|---|---|---|---|
| 4,074,225 | A * | 2/1978 | Vandeweghe | 340/524 |
| 6,778,071 | B2 * | 8/2004 | Megerle | 340/332 |
| 7,180,415 | B2 * | 2/2007 | Bankert et al. | 340/539.17 |
| 7,366,674 | B2 * | 4/2008 | Dione | 705/323 |
| 7,683,793 | B2 * | 3/2010 | Li et al. | 340/628 |
| 2012/0047083 | A1 | 2/2012 | Qiao | |

* cited by examiner

*Primary Examiner* — Hung T. Nguyen
(74) *Attorney, Agent, or Firm* — Robert Schuler

(57) ABSTRACT

An emergency notification and response system is linked to a fire alarm system, a security system and to a communication network over which it sends and receives emergency messages to and from building occupants and to emergency response personnel. The emergency notification and response system comprises a notification module which operates to receive signals from a fire detection system and send one or more messages to building occupants to investigate the validity of a possible fire event, and to respond to the message with an indication that a fire event is in progress or not. Depending upon information received in the response, the notification module sends an evacuation message to a selected sub-set of the building occupants that includes instructions for evacuating the building.

22 Claims, 9 Drawing Sheets

PRIOR ART FIRE ALARM SYSTEM 50
&
SECURITY SYSTEM 55

PRIOR ART FIRE ALARM SYSTEM 250
&
SECURITY SYSTEM 252

FIG. 5A

RESPONSE MSG. 500

TO: OCCUPANT 1
FM: COMM. MOD. 405
MSG.: PLEASE CHECK HALLWAY
FOR SMOKE/FIRE.
CONF.: PRESS 1 IF SMOKE/FIRE
__ (send)
PRESS 2 IF NO SMOKE/FIRE
__ (send)
PRESS 3 IF CAN'T CONFIRM
__ (send)

FIG. 5B

CONFIRMATION MSG. 510

TO: OCCUPANT 1
FM: COMM. MOD. 405
MSG.: PLEASE CHECK HALLWAY
FOR SMOKE/FIRE.
CONF.: PRESS 1 IF SMOKE/FIRE
1 (send)
PRESS 2 IF NO SMOKE/FIRE
__ (send)
PRESS 3 IF CAN'T CONFIRM
__ (send)

FIG. 6A

EVACUATION MSG. 600

TO: OCCUPANT 1
FM: COMM. MOD. 405
MSG.: PLEASE EVAC. USING ROUTE A

CONF.: PRESS 1 IF ABLE TO EVAC.
__ (send)
PRESS 2 IF NOT ABLE TO EVAC.
__ (send)

FIG. 6B

EVACUATION CONFIRMATION MSG. 610

TO: OCCUPANT 1
FM: COMM. MOD. 405
MSG.: PLEASE EVAC. USING ROUTE A

CONF.: PRESS 1 IF ABLE TO EVAC.
1 (send)
PRESS 2 IF NOT ABLE TO EVAC.
__ (send)

BUILDING EVACUATION SYSTEM WITH POSITIVE ACKNOWLEDGMENT

1. FIELD OF THE INVENTION

The present disclosure relates to a building evacuation system and to a protocol for ensuring that an event is real and then orchestrating an organized evacuation process.

2. BACKGROUND

Private and public buildings with single or multiple tenant occupancy are typically required by building codes to install a fire alarm system that generally operates to detect and annunciate a fire event. Such a fire alarm system 50 is illustrated in FIG. 1 and has one or more fire sensing devices S1-S11, such as heat detectors and smoke detectors, and manual call point or pull station devices R1 and R2 referred to herein as fire reporting devices, each of which is in communication with the fire alarm system 50. When a sensor device is activated, the alarm system typically controls a notification appliance N1 or N2 (siren, strobe, public address speaker) to emit an alert to the building occupants that a fire event or condition may have been detected. Depending upon the building size and use, some or all of the sensor devices can be in wired or wireless communication with the control panel, and each sensor device can have a unique identifier that can be separately addressed by the control panel. Addressable fire alarm control panels can operate to periodically poll each sensor for information relating to the state of the sensor device to determine whether or not it has been activated, and as the location of each addressable sensor device is known, the control panel is then able to determine where in the building a fire event may be in progress. This location information can be used by someone monitoring the panel to contact the appropriate emergency personal (i.e., fire department) to deal with the alarm and to direct them to the source of the alarm or fire event within the building. Recently, fire alarm systems have been designed to receive and process information gathered from the sensor devices, and use the results to automatically notify, via an emergency response system 51, emergency personal to a fire event. Further, alarm systems can use the information received from the sensor devices to inform the emergency personnel where in the building they should look for a fire.

Depending upon the type and size of a building, it may be necessary for the occupants to evacuate in the event that a fire alarm system sounds an alert. Building codes typically require that a building evacuation plan is displayed inside a building in a position such that it can be readily viewed by occupants during a fire emergency. Such evacuation plans can be a floor plan showing the occupants the best means of egress from the building, such as a red line from the location of the evacuation plan to the best egress. Some fire alarm systems are also designed to provide a fire emergency evacuation plan to building occupants via a mobile or stationary communication device, such as a smart phone or a stationary computer. In the event of a fire emergency, a fire emergency message can be broadcast by the fire alarm system to each building occupant notifying the occupants of the best evacuation route from the building.

In addition to the fire alarm system operation described above, some systems are designed to control notification appliances with which they communicate to annunciate a fire event in stages by activating the notification appliance(s) positioned closest to a fire first, and then activating other notification appliances positioned further from the fire event at later times, for instance.

Buildings with installed fire alarm systems can also have a security system installed as well. Such a security system 55 is illustrated in FIG. 1. Security systems are available that monitor the authorized entry and exit of occupants from a building, and which monitor the authorized entry and exit of building occupants from certain areas within the building. The security system 55 has a number of card or keyed entry devices S20-S23 in communication with a security system control panel associated with system 55. Each time an individual is authorized to enter or leave the building via one of the entry devices, the entry device transmits information to the control panel indicative of the individuals identity. Further, the security control panel can store information relative to a location in the building where the individual works or lives, such as an office location or an apartment location. Such a security system is able to monitor both the number and location of the current occupants in a building. As with the fire alarm system 50, the security system 55 can be connected to an emergency response system 56 which can operate to notify emergency personal as to the current number and location of the occupants in a building. Such information can be very useful to emergency personnel who are tasked with the responsibility to ensure that all the occupants of a building are safely evacuated in the case of a fire emergency, for instance.

FIG. 2 shows a fire alarm system 250 and a security system 252 that are substantially similar to the respective systems 50 and 55 described earlier with reference to FIG. 1, with the exception that the fire alarm system 250 and the security system 252 are in communication with a supervisory system 251. The supervisory system 251 in this case operates to monitor the polling information gathered by the fire control panel and the security control panel, and can use this information to generate and send an alert message to an appropriate emergency agency.

3. BRIEF DESCRIPTION OF THE DRAWINGS

The present invention can be best understood by reading the specification with reference to the following figures, in which:

FIGS. 5A and 5B are a logical flow diagram of the steps comprising one embodiment.

FIG. 6A illustrates the format of an evacuation message 600.

FIG. 6B illustrates the format of an evacuation confirmation message 610.

Figure 7A:
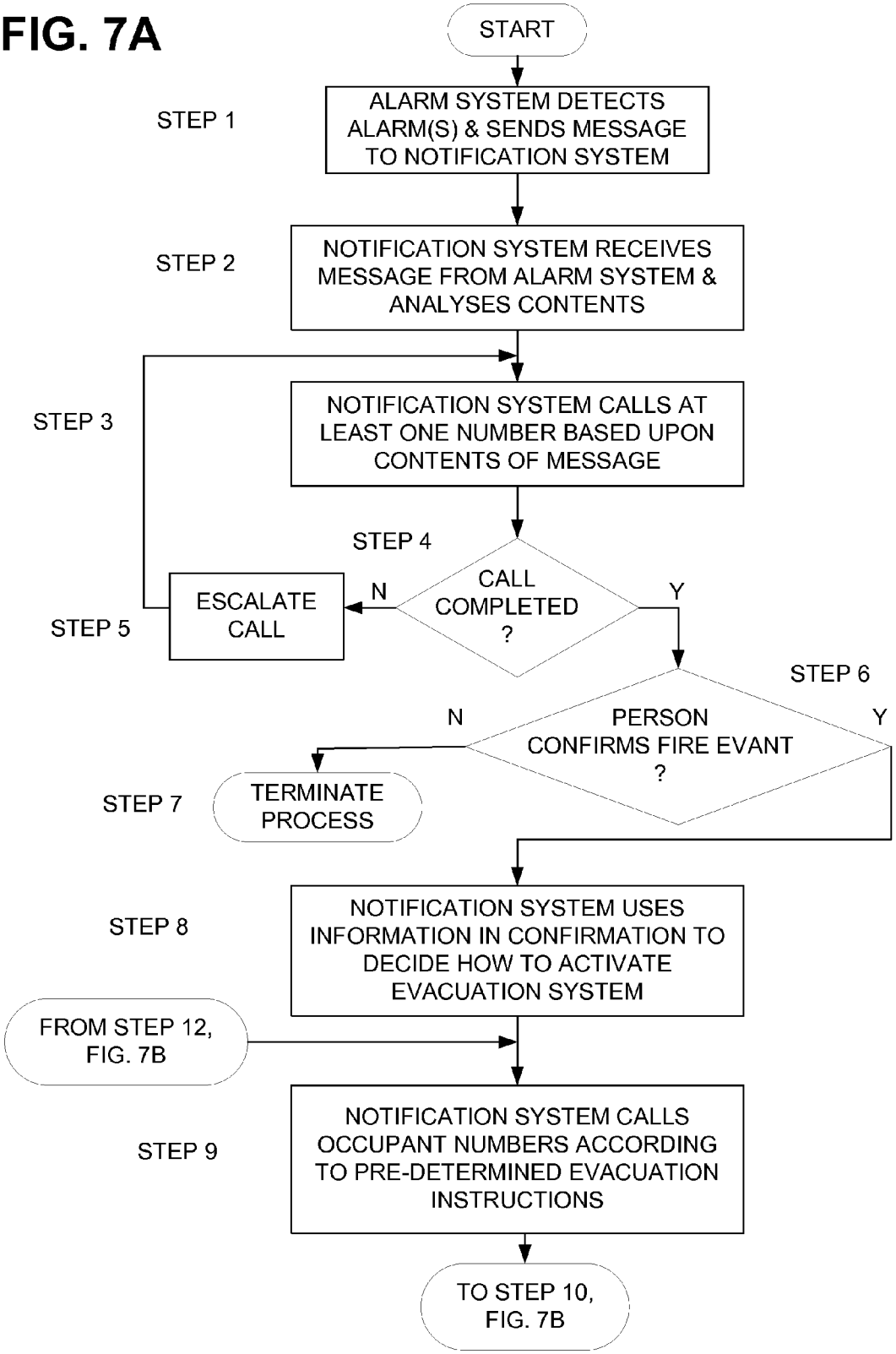
Figure 7B:
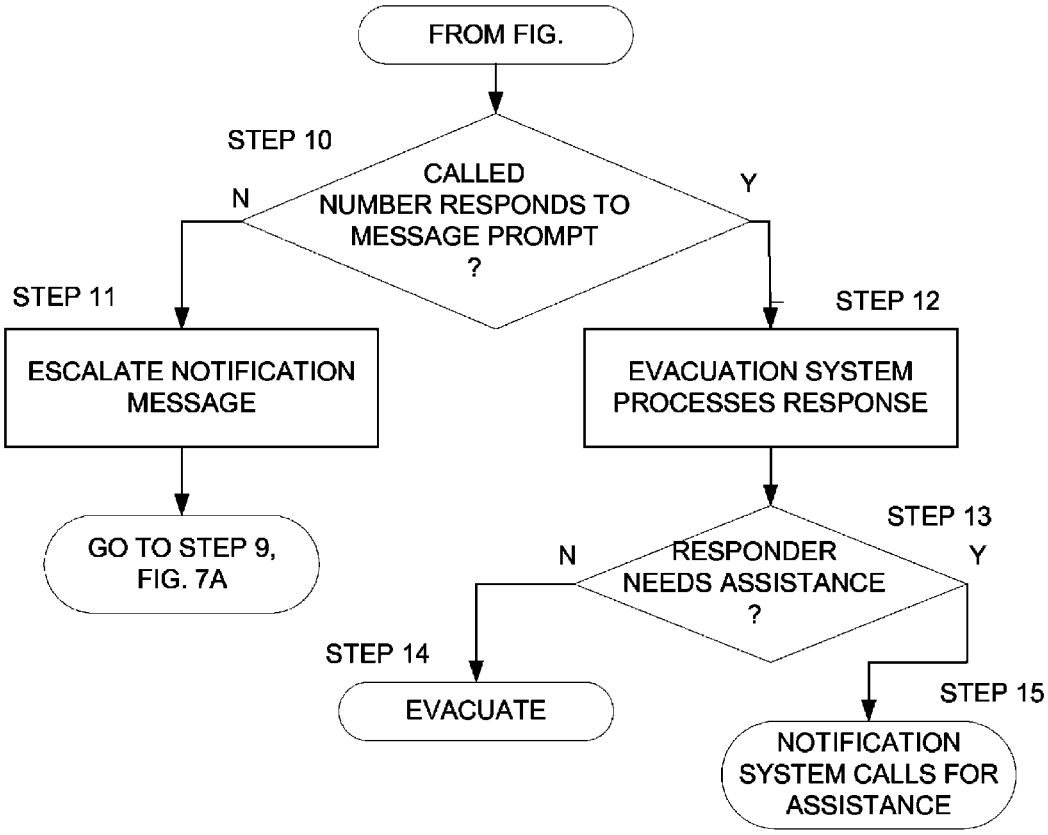

FIGS. 7A and 7B comprise a logical flow diagram of the operation of the supervisory emergency notification and response system 460.

4. DETAILED DESCRIPTION

While fire alarm systems reliably operate to notify building occupants that a fire emergency is in progress, these same systems can, under certain conditions, falsely notify the occupants that a fire emergency is in progress. Such a false notification, or false alarm, can be the result of a sensor detecting an event that has nothing to do with a fire emergency. For example, smoke detectors operate to detect very small particulate matter that comprises smoke. Unless a smoke sensor is properly deactivated or fire panel is put to zone bypass, a number of activities, such as drilling into a wall or stirring up quantities of fine, environmental dust material can cause a smoke detector to be activated falsely. Also, pull stations within a building can be easily activated by a prankster whether or not there is an actual fire emergency. Typically, when a fire alarm system is triggered, it is necessary for someone who is monitoring the system to go to the site of the alarm to confirm that a fire is in progress. While this is a practical solution in buildings that are staffed with an individual tasked with monitoring the system, many buildings (i.e., apartment complexes) are not staffed in this manner. In this case, the occupants are forced to evacuate the building without knowing if there is an actual fire emergency.

A significant issue for emergency responders during a building evacuation is determining whether all the building occupants have safely evacuated. While fire emergency systems are available that can transmit a message to individuals currently occupying a building informing them of a fire emergency and instructing them on the best egress from the building, there is no way to know whether or not each individual has actually received the message, and therefore there is no way to know whether the individual is actually able to exit the building and whether they will use the best route to egress the building.

Therefore, it is desirable to both eliminate false alarms associated with the operation of a fire emergency system and to positively determine whether all building occupants are able to and have safely evacuated a building during a fire emergency by the safest egress route. These and other deficiencies in current fire emergency systems are addressed in a novel emergency notification and response system that provides positive feedback from building occupants to validate a fire emergency event, that times the transmission of evacuation messages to individual building occupants based upon their proximity to the fire emergency event, and that receives positive acknowledgement from the occupants to which each evacuation message is transmitted.

According to one embodiment of the invention, a central emergency notification and response system is in communication with a building security system from which it receives occupancy information, and it is in communication with a fire emergency system from which it receives fire alarm information. The central emergency notification and response system employs the occupancy information to transmit one or more confirmation messages to one or more occupants who are proximate to a sensor that is activated. The one or more confirmation messages include a request that the occupant investigate to determine if there is an actual fire event or not, and if so, respond by positively acknowledging the fire emergency. In the event that an actual fire event is verified, the central emergency notification and response system can then transmit a message to only those building occupants who are closest to the fire which includes information regarding the best route for evacuation from the building and that requests the occupant to positively acknowledge that they are received the emergency evacuation message. Further, the occupant can respond to the emergency evacuation message by indicating that they are physically able to evacuate the building or not, and if not, the emergency notification and response system can generate and send a message to emergency responders indicating that an occupant needs assistance in evacuating the building and indicating the location of the occupant within the building.

Figure 1:
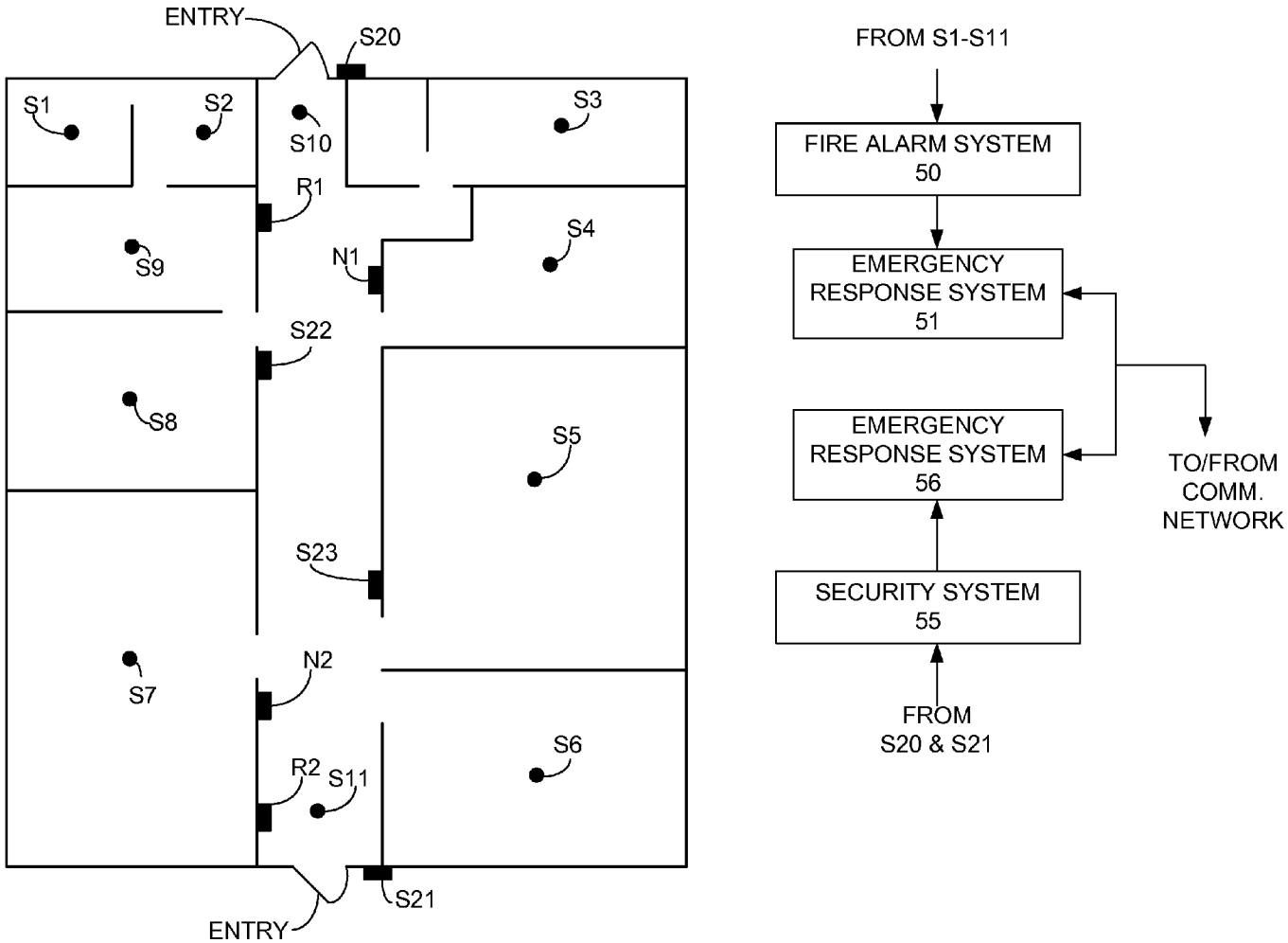
FIG. 1 is a diagram showing an alarm system 50 and a security system 55.
Figure 2:
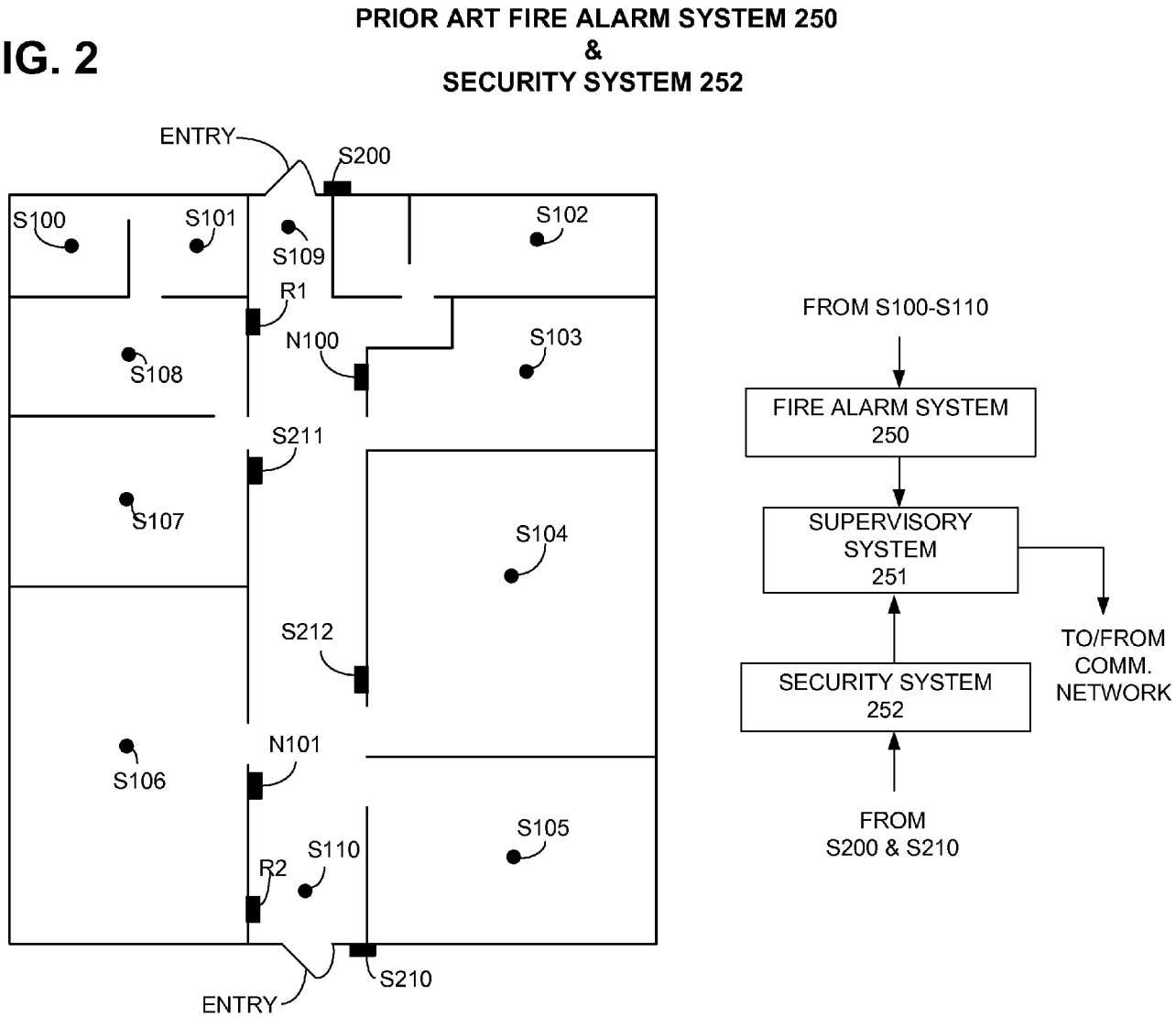
FIG. 2 is a diagram showing an alarm system 250 and a Security System 252.
Figure 3A:
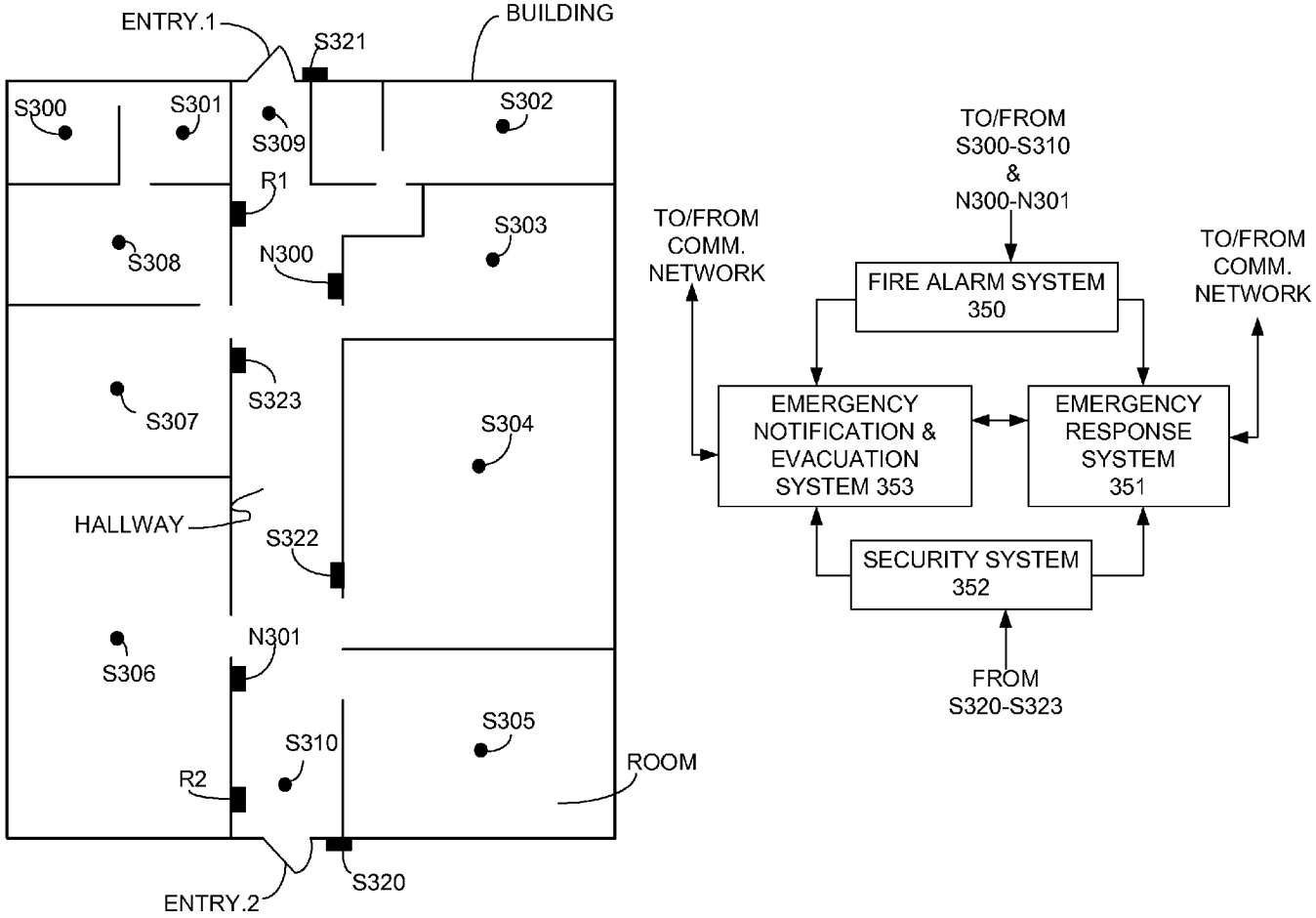
FIG. 3A is a diagram showing an environment in which an emergency notification and evacuation system 353 operates.

As described earlier, building codes typically require that fire emergency systems be installed that include heat and smoke sensors to detect a fire event, and they include a sprinkler system to extinguish the fire once it is in progress. The location of heat and smoke sensors as well as sprinkler heads are specified in building codes so that they are optimally positioned to detect a fire event. FIG. 3A illustrates the positions of heat and/or fire sensors S300 to S310 in a building with some number of rooms and two means of egress (Entry.1 and Entry.2) at either end of a hallway. Each room in the building is shown to have one sensor, but can have more than one sensor depending upon the size and configuration of the room, and the hallway is shown to have two sensors, S309 and S310, positioned proximate to each of the entry doors. The sensor positions in each of the rooms and the hallway are for illustrative purposes only, and are not intended to conform to any building codes. Also located in the building hallway are two notification appliances, N300 and N301, each one of which can be an annunciation device (siren or loudspeaker) that emits a sound, each one of which can be a warning light (strobe) or each one of which can include both and enunciator and a warning light. Reporting devices R1 and R2 (pull stations or phones) are also shown located in the building hallway and can be operated by a building occupant to report a fire event. Also, the two entry doors, entry.1 and entry.2, are secured with a card or keyed entry device, and in this case two of the interior building doors are secured with a card entry or keyed entry device S322 and S323. Each of the sensors S300 to S310, both of the notification appliances N300 and N301, and each of the door security devices S320, S321, S322 and S323 are in wired or wireless communication with either a fire alarm system 350 or a security system 352.

Continuing to refer to FIG. 3A, an emergency notification and evacuation system 353 and an emergency response system 351 are in communication with each other, and each of the systems 351 and 353 are connected to the fire alarm system 350 and the security system 352 as well as each also being connected to a public or private communication network, such as a POTS network, the Internet or an Ethernet. Depending upon how the fire alarm system 350 is configured, it can operate to monitor (using proprietary communication protocols such as BACnet/IP, ARCNET, Point-To-Point, RS-232, RS-485, LonTalk, or using the Ethernet protocol) the heat and smoke sensors S300 to S310, and in the event that one or more of the sensors are active, it can display the location of the active sensor(s) on a screen or a panel for observation by an individual tasked with the responsibility to monitor the system, it can send an activation message to one or both of the notification appliances N300 and N301 to annunciate an emergency evacuation alarm, and it can generate and transmit a fire emergency message to the emergency response system 351. Depending upon the information included in the fire emergency message, the system 351 can generate and transmit an emergency response message over the network to an emergency response organization, such as a fire department or police) that includes information corresponding to the building fire event. Further, the emergency notification and evacuation system 353 can receive information in a fire emergency message from the fire alarm system 350 indicating that one or more fire sensors are active, and then use this information to generate and transmit a fire confirmation message (confirmation message) over the communication network to one or more building occupants proximate to the active sensor notifying them that a fire event may exist, and directing them to investigate. Depending upon the result of the investigation, the occupant can then respond to the confirmation message from the system 353 with an indication that there is or is not a fire event in progress. In the event that the system 353 does not receive a response from the one or more building occupants, it can escalate the message to other occupants that are also proximate to the active sensor. Operating in this manner, the emergency notification and evacuation system 353 can operate to positively acknowledge a fire event and avoid initiating an evacuation process caused by a false alarm.

While the confirmation message sent to each building occupant proximate to the location of an active sensor can prompt the occupant to respond with a simple positive or negative acknowledgment, the occupant can also be prompted to respond with other information as well, such as whether or not a fire event is blocking an egress from the building. Regardless of the information received by the system 353 in an acknowledgement from an occupant of the building (occupant acknowledgement), the system 353 sends information in the acknowledgment message to the emergency response system 351 which uses this information to make an evacuation decision, and if a decision is made to evacuate the building, the information received in the acknowledgement message can be used by the system 351 to select one or more evacuation plans from among a group of two or more plans.

Figure 3B:
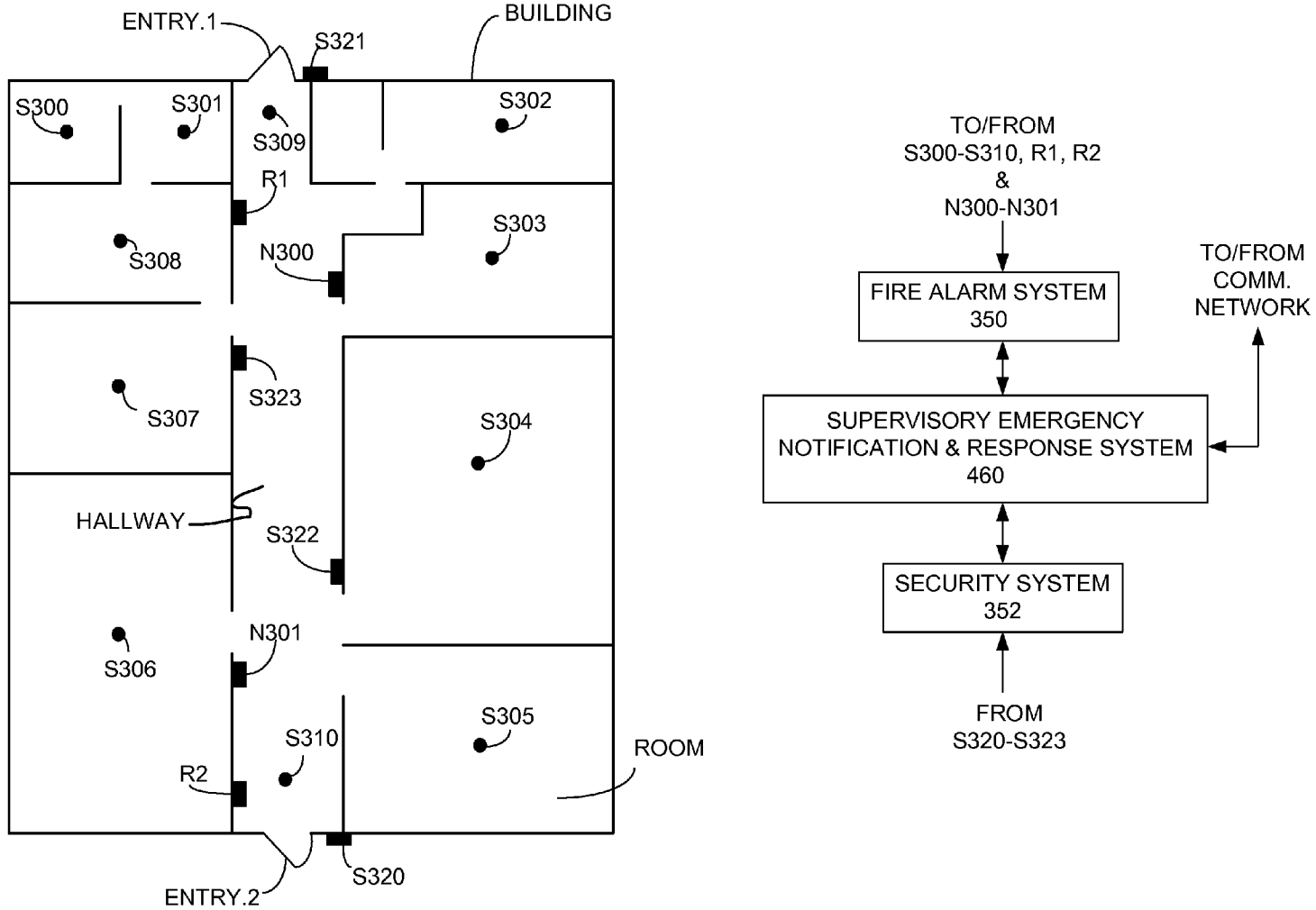
FIG. 3B is a diagram showing an environment in which a supervisory emergency notification and evacuation system 460 operates.

The functionality comprising systems 351 and 353 described with reference to FIG. 3A can be implemented in specially designed computer instructions (computer code) that are stored in non-volatile memory in a suitable computational device, such as a network server. While FIG. 3A shows the functionality comprising the systems 351 and 353 implemented in two separate devices or locations, each of which is in communication with the other, this need not be the case. FIG. 3B shows a single supervisory emergency notification and response system 460 that comprises substantially all of the functionality associated with both the emergency notification and evacuation system 353 and the emergency response system 351. According to the embodiment illustrated in FIG. 3B, substantially all of the computer code comprising the systems 351 and 353 can be stored in non-volatile memory in the single system 460 computational device, and the single system 460 can operate in a similar manner as the two separate systems 351 and 353 to detect a fire event, to notify building occupants and to notify emergency response personnel.

Figure 4:
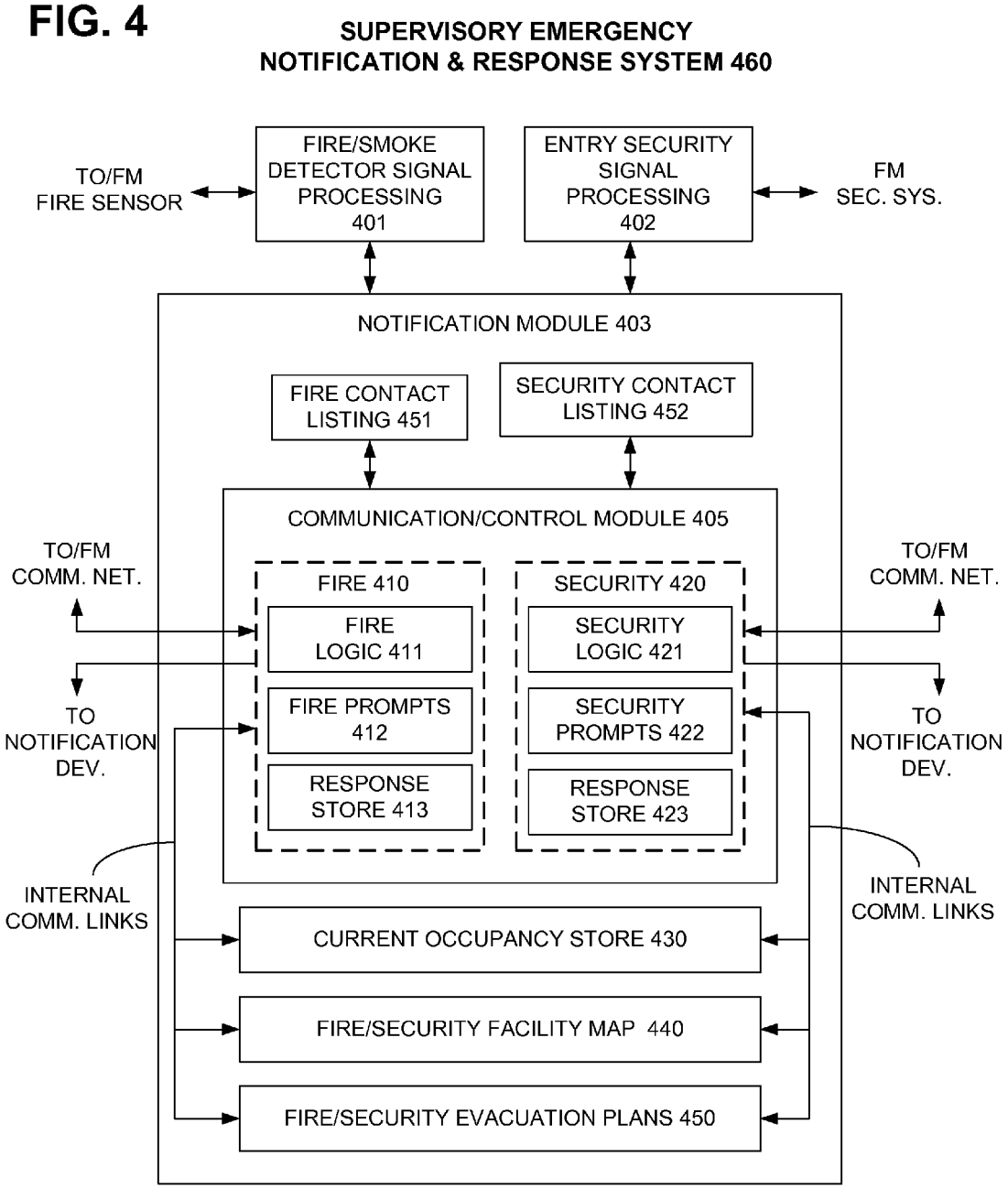
FIG. 4 is a block diagram showing the functional elements comprising the supervisory emergency notification and response system 460.

FIG. 4 illustrates functional elements comprising the supervisory emergency notification and response system 460 described earlier with reference to FIG. 3B. The system 460 has a fire/smoke detector signal processing module 401 and an entry security signal processing module 402 both of which operate to receive information from and send command messages to any one or more of the component parts of a respective fire alarm and security system. So, for instance, the signal processing module 401 can operate to receive information in an alarm signal from any of the sensors S300 to S310 or reporting devices R1 and R1, and it can operate to send a control command in a message to any of the notification devices N300 and N301 causing them to announce a fire emergency. By the same token, the entry security signal processing module 402 can operate to receive information in an alarm signal from any of the security devices S320, S321, S322 and S323, and it can operate to send a control command in a message to any of the notification devices. Depending upon whether the sensors are addressable or not, sensor information can be selectively received, or nor selectively received, from each one of the sensors connected to the respective processing modules 401 and 402.

Each of the signal processing modules 401 and 402 are in communication with a notification module 403 that generally operates to use information received from a fire alarm and security system to actuate the various types of notification appliances associated with each of the systems. The notification module 403 also operates using information received from the fire alarm and security systems to send messages to occupants of the building and to emergency responders. More specifically, the notification module 403 has a communication and control module 405, a store of the current building occupants 430, a fire and security facility map 440, a store of evacuation plans 450 for both fire and security emergencies, and fire and security contact listings 451 and 452 respectively.

The communication and control module 405 comprising the notification module 403 in FIG. 4 generally operates to use information gathered from the various fire alarm system sensors and reporting devices, and from the security system sensors to make decisions to control the activation of some or all of the notification devices connected to the systems, and to make decisions relative to sending emergency response messages to building occupants and to emergency responders, such as the police or fire department. The current occupancy store 430 comprising the notification module 403 includes information identifying each of a building occupant that is currently located within the building. This occupant information can be received from security card readers and from keyed entry devices associated with the security system, and the occupant information can be maintained by any appropriate database management system (not shown). Information corresponding to each individual authorized to enter the building can include the individuals name, a security code associated with the individual, and information used as a key or tag into the fire contact listing 451. The fire/security facility map 440 can include information that uniquely identifies each fire sensor (S300 to S310), each fire reporting device (R1 and R2), and each security device (card readers and keyed entry devices), and it can include information that identifies a position within the building of each device with respect to a building floor plan. The unique identity of each fire or security device is associated with a building location in a table (not shown), and information in the occupancy store 430 and the map store 440 can be used by the communication module to identify occupants to send emergency response messages to. And finally, the store of fire/security evacuation plans 450 can include information in various forms that can be sent to the building occupants which guides them to the best emergency exit. This information can be in the form of a text message prompting one or more building occupants to evacuate the building using the most direct path to a particular exit, or it can be in the form of an evacuation route for display on a display device (portable or not portable). Some or all of the information in the current occupancy store 430, in the facility map 440 and in the evacuation plan store 450 is accessible by the communication module 405 which uses this information, and information received from the signal processing modules 401 and 402 to make decisions regarding whether an actual fire event is taking place, and if so, how to best evacuate the current building occupants. Further, the communication module 403 uses information received in responses to messages sent by it to the current occupants to determine which occupants should evacuate first, and then which occupants should evacuate at one or more later times. Still further, the module 403 uses information in messages sent to it by one or more current building occupants in order to determine whether those occupants have received the evacuation route information and whether they are actually able to evacuate without assistance.

The communication and control module 405 of FIG. 4 has both a fire emergency communication and control element 410 and a security communication and control element 420. Both of the elements 410 and 420 include specially designed computer code 411 and 421, prompt information 412 and 422, and occupant and emergency personnel response information stores 413 and 423 respectively. The computer codes 411 and 421 each operate independently on information received from both the fire and security systems respectively, they operate on information stored in conjunction with the notification module 403, and they operate on information received from building occupants to make logical decisions regarding how, which ones, and at what times to notify building occupants and emergency response personnel in the event of a possible and/or a confirmed fire event, and to select the optimal evacuation plan for the occupants. The operation of the fire logic 411 is described later with reference to FIGS. 7A and 7B. Information in the store of fire prompts 412 can be used by the communication module 405 to generate one or more fire emergency response messages that are transmitted over a local or wide area network (Ethernet of Internet) to one or more selected building occupants. One type of fire emergency response message can include either a text or a voice prompt requesting that the occupant receiving the message investigate a possible fire event in order to determine whether an event is actually taking place, or if a false alarm has been detected by the fire alarm system. In either case, the text or voice prompt can include instructions to either confirm that a fire event is in progress or confirm that a fire event is not in progress, and this information is sent back to the response system 460 by the occupant in a confirmation message for storage in the response store 413. Another type of fire emergency response message send to an occupant can include selected evacuation route information as well as information prompting the occupant to confirm receipt of the message and to confirm that they are able to safely evacuate the building with or without assistance.

The format of and information comprising a first type of fire emergency response message is illustrated with reference to FIG. 5A and FIG. 5B respectively. The fire emergency response message 500 shown in FIG. 5A is shown to have the identity of a building occupant to which the message is sent, the identity of the emergency system from which the message is sent, and a prompt requesting the occupant to investigate a possible fire event. The message also has three confirmation fields, one of which can be selected by the occupant to indicate whether or not a fire event is in progress and whether or not they are physically able to confirm this or not. FIG. 5B illustrates the message of FIG. 5A after the occupant has selected one of the three confirmation fields. This message, a fire emergency confirmation message 510 is send back to the emergency response system 460 by the occupant. In this case, the occupant has selected the first field indicating that a fire event is in progress at their location within the building. It should be understood, that the number and types of fields comprising the messages 500 and 510 are not fixed, but can be configured differently depending upon the type of building (hotel, apartment, hospital) that the system 460 is supporting.

A second type of fire emergency response message is described with reference to FIGS. 6A and 6B. A fire emergency evacuation response message 600 has four fields, with a first field having the identity of a building occupant, a second field having the identity of an emergency system, a third field having information corresponding to a suggested evacuation route, and a forth field prompting the occupant to confirm that they are able to evacuate the building or not. FIG. 6B shows the message of FIG. 6A after the occupant has entered confirmation that they are able to evacuate the building. After this confirmation information is entered into the confirmation message 510 is sent back to the emergency system for processing.

While two different types of fire emergency response messages are described above, it should be understood that the number of messages generated by a fire emergency system, such as the system 460 in FIG. 3B, is not limited to only these two types of messages. Depending upon the emergency system design and depending upon the type of building that the system is operating to support, other types of emergency response messages can be generated and sent to occupants or to emergency responders.

The logical operation of the notification module 403, described with reference to FIG. 4, to make decisions regarding how, which ones, and at what times to notify building occupants and emergency response personnel in the event of a possible and/or a confirmed fire event will now be described with reference to FIGS. 7A and 7B. In Step 1, either a fire sensor or a fire reporting device is activated and this change in state can be detected by a fire alarm system, such as the system 350 in FIG. 3B. In response, the fire alarm system can send a message to the emergency notification and response system 460 which includes the identity of the fire sensor or reporting device. In Step 2, the system 460 processes (signal processing 401) the message received from the fire alarm system for information identifying a fire sensor or reporting device and sends this identification information to the notification module 403. The fire logic 411 in the notification module 403 compares the identity information of the fire sensor or reporting device it receives to identification information stored in the map store 440 to determine the location within the building of the sensor or reporting device. After determining the location of the active sensor or reporting device, the logic 411 examines the occupancy store 430 to determine which of one or more current building occupants is/are proximate to the location of the active sensor or reporting device. After identifying the occupants that are proximate to the active sensor or reporting device, the logic 411 then uses information in the fire contact listing 451 and the fire prompts 412 to generate a fire emergency response message and, in Step 3 sends this message over a POTS or other communication network to the one or more building occupants.

Continuing to refer to FIG. 7A, in Step 4 the notification module 403 determines that a communication session (call) to the building occupant or occupants is completed (phone goes off hook or the communication system receives an ACK that the message is received by a communication device under the control of the occupant) or not, and if not more than a selected number of the occupants receives the message, then the process of sending the fire emergency response message proceeds to Step 5, and the same message is resent to one or more other building occupants. In this context, the number of building occupants to which a fire emergency response message is sent can be programmed to be at least one occupant, or it can be two or more occupants depending upon the type of message and depending upon where in a building the fire event is detected, and depending upon how many occupants are currently in the building. However, in the event that at least the selected number of occupants receive the message, then the process proceeds to Step 6 at which time a response to the fire emergency response message is receive from at least one occupant that includes information confirming or not confirming a fire event, and this information is stored in the response store 413. In the case that a fire event is not confirmed (i.e., all responses indicate that there is no fire), then the process proceeds to Step 7 and the system 460 determines that a false alarm has been triggered. At this point, the condition that led to the false alarm being triggered can be investigated. In the case that a fire event is confirmed (i.e., at least one response indicates that a fire is in progress), then the process proceeds to Step 8 and the fire logic 411 uses information in one or more occupant confirmation messages in the store 413 and information included in one or more fire evacuation plans stored in the evacuation plan store 450 to determine how, who, and when to alert the building occupants to the fire event. An evacuation plan can be selected by the logic 411 according to the location in the building that the fire event is detected and confirmed, or a plan can be selected according to the location of current building occupants and the location of a confirmed fire event, or a plan can be selected for other reasons, but after an evacuation plan is selected, in Step 9 the communication module 406 proceeds to send an fire emergency response message, similar to the message described with reference to FIG. 6A, to the appropriate building occupants. This message has fire emergency evacuation route directions/instructions that when followed will lead the occupants to safely evacuate the building. This message also requests that the occupants, to which the message is sent, respond by confirming that they received the message. Not all of the occupants in a building need to be sent a fire emergency evacuation message at the same time. The same, or similar message can be sent to different groups of building occupants in a staged process at different times, whereby those occupants who are currently within a specified distance from a detected fire event are sent an evacuation message first, such as all occupants currently on a floor on which the fire is detected. Subsequent similar messages can then be sent to building occupants who beyond the specified distance and who are on different floors. One or more distances can be specified depending upon the size of a building and the number of occupants in the building. These staged messages can be different to the extent that they are sent to a different group of occupants and to the extent that they can convey different evacuation routes or evacuation instructions. In Step 10, the occupant(s) respond or not to the prompt in the fire emergency evacuation message with a confirmation message that the notification module 403 receives or does not receive. If a confirmation message is not received, then in Step 11, the module 403 can escalate the evacuation process by generating and sending a message to either an emergency response organization or to any other appropriate individual indicating that one or more current building occupants did not respond. On the other hand, if one or more building occupants do respond to the evacuation message, then in Step 12 the fire logic 411 examines the information in the response or responses to determine if the system 460 should take any further action.

With continued reference to Step 12 in FIG. 7B, an occupant can respond to an evacuation message, such as the message described with reference to FIG. 6A, by indicating that they received the message and are able to evacuate, or that they received the message and need assistance evacuating. If in Step 13, the fire logic 411 determines that an occupant responding to a message does not need assistance, then the process proceeds to Step 14 and takes no further action with respect to that occupant. On the other hand, if in Step 13 it is determined that an occupant does need assistance, then the communication module 405 generates and sends a message to either an emergency response department or to some other appropriate individual indicating that a particular occupant is in need of assistance.

While an embodiment of the invention is described in the context of a fire emergency evacuation process, the evacuation process is not limited to only a fire emergency, but can also be applied to a security emergency as well. The forgoing description, for purposes of explanation, used specific nomenclature to provide a thorough understanding of the invention. However, it will be apparent to one skilled in the art that specific details are not required in order to practice the invention. Thus, the forgoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

I claim:

1. An emergency evacuation method, comprising:

an emergency notification and response system receiving information from a fire alarm system indicating that a fire event is in progress;

sending a first message to a communication device under the control of a first building occupant proximate to the fire event that includes a prompt requesting the first building occupant to respond by confirming that a fire event is in progress or not; and if a response to the first message is received from the first building occupant confirming that a fire event is in progress, using information in the response to select the most appropriate one of a set of two or more building evacuation plans stored in association with the emergency notification and response system, and sending an evacuation message to a first group of two or more building occupants including information prompting the occupants to leave the building according to the selected evacuation plan.

2. The emergency evacuation method of claim 1, wherein the building occupants comprising the first group of two or more building occupants are selected from a group of all the current building occupants that are within a selected distance from the confirmed fire event.

3. The emergency evacuation method of claim 1, further comprising using information stored in association with the emergency notification and response system to select the most appropriate evacuation plan.

4. The emergency evacuation method of claim 3, wherein the information stored in association with the emergency notification and response system used to select the most appropriate evacuation plan is comprised of one or more of a listing of current building occupants, a set building maps, and a set of evacuation plans.

5. The emergency evacuation method of claim 1, further comprising the emergency notification and response system not receiving a response to the first message from the first building occupant, and sending a second message to a communication device under the control of a second building occupant proximate to the fire event that includes a prompt requesting the second building occupant to respond by confirming that a fire event is in progress or not; and if a response to the second message is received from the second building occupant confirming that a fire event is in progress, using information in the response to select the most appropriate one of a set of two or more building evacuation plans stored in association with the emergency notification and response system, and sending an evacuation message to a first group of two or more building occupants including information prompting the occupants to leave the building according to the selected evacuation plan.

6. The emergency evacuation method of claim 1, further comprising the emergency notification and response system operating to detect an acknowledgment that each of the building occupants which are sent the evacuation message receive the message.

7. The emergency evacuation method of claim 1, wherein the evacuation message comprises a request that the occupant respond with an indication that they are not able to leave the building.

8. The emergency evacuation method of claim 7, further comprising the emergency notification and response system sending a third message to an appropriate emergency response organization indicating that a building occupant needs assistance evacuating the building.

9. The emergency evacuation method of claim 1, wherein the first building occupant is selected from among a set of building occupants in a current occupancy store.

10. The emergency evacuation method of claim 9, wherein the current occupancy store comprises building occupants who are currently in the building.

11. The emergency evacuation method of claim 10, wherein the current occupants of the building are detected by a security system and reported to the emergency notification and response system.

12. An emergency notification and response system, comprising:

a computation device having non-volatile computer memory in which is stored a set of computer instructions that operate to process a fire alarm system signal received by the computation device over a communication network, and to use the results of the processed fire alarm signal to generate and send a first message to a communication device under the control of a first building occupant proximate to the fire event that includes a prompt requesting the first building occupant to respond by confirming that a fire event is in progress or not; and the computation device receiving a response to the first message from the first building occupant including information confirming that a fire event is in progress, using information in the response to select the most appropriate one of a set of two or more building evacuation plans stored in association with non-volatile computer memory, and sending an evacuation message to a first group of two or more building occupants including information prompting the occupants to leave the building according to the selected evacuation plan.

13. The emergency notification and response system of claim 12, wherein the building occupants comprising the first group of two or more building occupants are selected from a group of all the current building occupants that are within a selected distance from the confirmed fire event, the group of all the current building occupants being stored in the non-volatile computer memory associated with the computational device.

14. The emergency notification and response system of claim 12, further comprising using information stored in non-volatile computer memory associated with the computational device to select the most appropriate evacuation plan.

15. The emergency notification and response system of claim 14, wherein the information stored in association with the emergency notification and response system used to select the most appropriate evacuation plan is comprised of one or more of a listing of current building occupants, a set building maps, and a set of evacuation plans.

16. The emergency notification and response system of claim 12, further comprising the computational device not receiving a response to the first message from the first building occupant, and sending a second message to a communication device under the control of a second building occupant proximate to the fire event that includes a prompt requesting the second building occupant to respond by confirming that a fire event is in progress or not; and if the computational device receives a response to the second message from the second building occupant confirming that a fire event is in progress, using information in the response to select the most appropriate one of a set of two or more building evacuation plans stored in non-volatile memory, and sending an evacuation message to a first group of two or more building occupants including information prompting the occupants to leave the building according to the selected evacuation plan.

17. The emergency notification and response system of claim 12, further comprising the computer instructions stored in non-volatile memory operating to detect an acknowledgment that each of the building occupants which are sent the evacuation message receive the message.

18. The emergency notification and response system of claim 12, wherein the evacuation message comprises a request that the occupant respond with an indication that they are not able to leave the building.

19. The emergency notification and response system of claim 18, further comprising the computational device sending a third message to an appropriate emergency response organization indicating that a building occupant needs assistance evacuating the building.

20. The emergency notification and response system of claim 12, wherein the first building occupant is selected from among a set of building occupants in a current occupancy store.

21. The emergency notification and response system of claim 20, wherein the current occupancy store comprises building occupants who are currently in the building.

22. The emergency notification and response system of claim 21, wherein the current occupants of the building are detected by a security system and reported to the computational device comprising the emergency notification and response system.

* * * * *